US009200547B2

(12) United States Patent
Hayman et al.

(10) Patent No.: US 9,200,547 B2
(45) Date of Patent: Dec. 1, 2015

(54) EFFICIENT PHASER ACTUATION SUPPLY SYSTEM

(71) Applicant: GM Global Technology Operations LLC, Detroit, MI (US)

(72) Inventors: Alan W. Hayman, Romeo, MI (US); David R. Staley, Flushing, MI (US); Eric D. Staley, Flushing, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/048,392

(22) Filed: Oct. 8, 2013

(65) Prior Publication Data

US 2015/0096511 A1 Apr. 9, 2015

(51) Int. Cl.

| | |
|---|---|
| ***F01L 1/34*** | (2006.01) |
| ***F01L 1/344*** | (2006.01) |
| ***F01M 1/16*** | (2006.01) |
| *F01M 1/12* | (2006.01) |

(52) U.S. Cl.

CPC ..... *F01L 1/3442* (2013.01); *F01M 1/16* (2013.01); *F01L 2001/34423* (2013.01); *F01L 2001/34446* (2013.01); *F01M 1/12* (2013.01); *F01M 2001/123* (2013.01)

(58) Field of Classification Search

CPC ..... F01L 2001/34423; F01L 2001/34446; F01L 1/3442; F01M 2001/123; F01M 1/12; F01M 1/16

USPC ..... 123/90.15, 90.17, 90.31, 90.12

See application file for complete search history.

(56) References Cited

U.S. PATENT DOCUMENTS

| | | | | |
|---|---|---|---|---|
| 7,836,857 | B2 * | 11/2010 | Knecht et al. | 123/90.12 |
| 2003/0188704 | A1 * | 10/2003 | Aimone | 123/90.17 |
| 2006/0157010 | A1 * | 7/2006 | Moriwaki et al. | 123/90.13 |
| 2010/0206253 | A1 * | 8/2010 | Fujimoto et al. | 123/90.15 |

* cited by examiner

*Primary Examiner* — Zelalem Eshete

(74) *Attorney, Agent, or Firm* — Harness, Dickey & Pierce, P.L.C.

(57) ABSTRACT

A hydraulic cam phaser includes at least one of an advance chamber and a retard chamber for receiving hydraulic fluid for advancing or retarding a rotational position of the camshaft. The hydraulic actuation system includes a hydraulic accumulator in selective communication with the at least one of the advance and retard chambers of the hydraulic cam phaser. A first system oil pump provides lubrication oil to the valvetrain system, and the hydraulic actuation system includes a second oil pump for supplying oil to the hydraulic accumulator. The second oil pump is controlled with a clutch device connecting the second oil pump to the engine drive system. The internal combustion engine includes a controller which controls actuation of the clutch device to actuate the clutch device during deceleration of the vehicle.

12 Claims, 2 Drawing Sheets

EFFICIENT PHASER ACTUATION SUPPLY SYSTEM

FIELD

Figure 1:
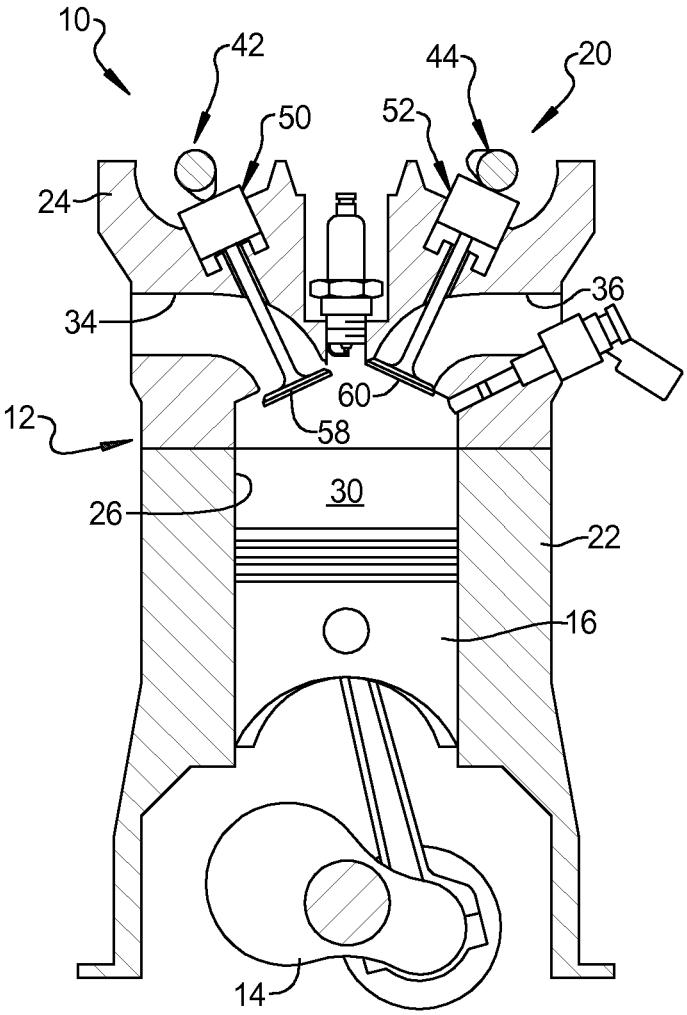

The present disclosure relates to an internal combustion engine and more particular, to an internal combustion engine having an efficient cam phaser actuation supply system.

BACKGROUND

This section provides background information related to the present disclosure which is not necessarily prior art.

Camshaft phasers have been widely used in internal combustion engines to very valve timing to achieve purposes such as lower emissions, increase peak power at high revolution speeds and improve idle quality. Camshaft phasers are normally operated using pressurized hydraulic fluid which require engine operation. Accordingly, camshaft phaser systems are typically not capable of operation during engine off conditions. Engine start-up can be adversely affected due to a broad range of temperatures and can be improved by reducing the compression ratios at start-up. Accordingly, it is desirable to provide a camshaft phaser system that is capable of camshaft adjustment during engine off conditions in order to improve engine start-up with low-cost and minimum adverse impact on engine parasitic losses.

SUMMARY

This section provides a general summary of the disclosure, and is not a comprehensive disclosure of its full scope or all of its features.

An internal combustion engine for a vehicle is provided including an engine block defining a plurality of cylinders. A cylinder head is mounted to the engine block and defines intake ports and exhaust ports in communication with the cylinders. A valve train system includes a plurality of intake valves disposed within the intake ports and a plurality of exhaust valves disposed within the exhaust ports. One or more camshaft and a plurality of valve lift mechanisms are operable to open the plurality of intake valves and the plurality of exhaust valves. A hydraulic cam phaser includes at least one of an advance chamber and a retard chamber for receiving hydraulic fluid for selectively advancing or retarding a rotational position of the camshaft. The hydraulic actuation system includes a hydraulic accumulator in selective communication with at least one of the advance and retard chambers of the hydraulic cam phaser. A first system oil pump provides lubrication oil to the entire engine, and the hydraulic actuation system includes a second oil pump for supplying oil to said hydraulic accumulator. The first system oil pump and the second oil pump are driven by an engine drive system. The second oil pump is controlled with a clutch device connecting the second oil pump to the engine drive system. The internal combustion engine includes a controller which controls actuation of the clutch device to actuate the clutch device during deceleration of the vehicle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
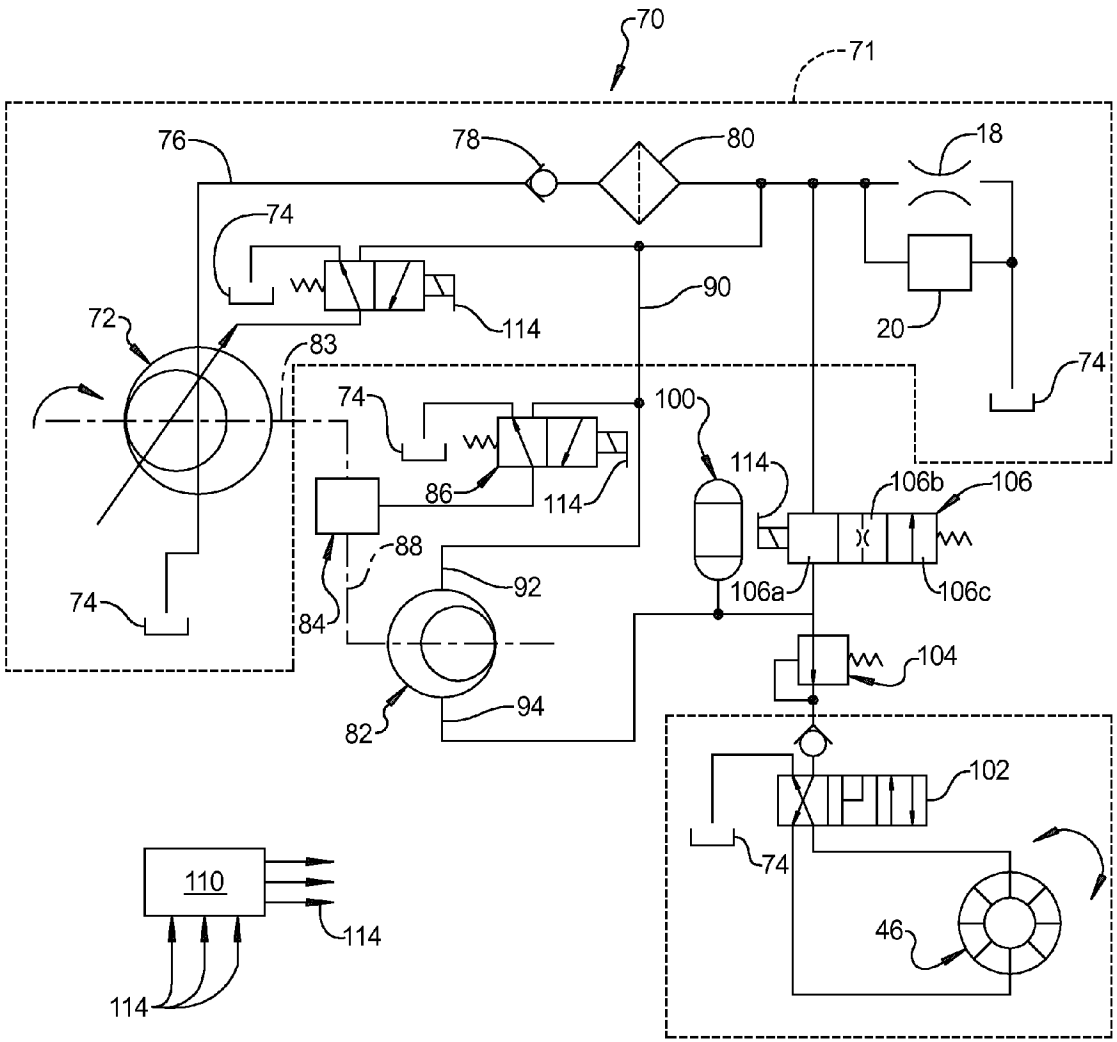

FIG. 1 is a sectional view of an engine assembly according to the principles of the present disclosure; and FIG. 2 is a schematic diagram of a hydraulic cam phaser actuation supply system according to the principles of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "in communication with" another element or layer, it may be directly on, engaged, connected or in communication with the other element or layer, or intervening elements or layers may be present. In contrast, when an element is referred to as being "directly on," "directly engaged to," "directly connected to," or "directly in communication with" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

An exemplary engine assembly 10 is illustrated in FIG. 1 and may include an engine structure 12, a crankshaft 14, a plurality of pistons 16, engine bearings 18 (FIG. 2) and a valvetrain assembly 20. The engine structure 12 may include an engine block 22 and a cylinder head 24. The engine structure 12 defines a plurality of cylinder bores 26(one cylinder is illustrated for simplicity). However, it is understood that the present teachings apply to any number of piston-cylinder arrangements and a variety of reciprocating engine configurations including, but not limited to, V-engines, inline engines, and horizontally opposed engines, as well as both overhead cam (both single and dual overhead cam) and cam-in-block configurations.

The pistons 16 are each located in one of the cylinder bores 26. The cylinder head 24 cooperates with the cylinder bores 26 and the pistons 16 to define a plurality of combustion chambers 30. The engine structure 12 defines one or more intake ports 34 and one or more exhaust ports 36 in the cylinder head 24 in communication with the combustion chambers 30.

With reference to FIG. 1, the valvetrain assembly 20 may include a first camshaft 42, a second camshaft 44 as well as first and the second valve lift mechanisms 50, 52 associated with each of the intake and exhaust ports 34, 36, respectively.

As shown in FIG. 2, a cam phaser 46 can be connected to the first or second camshaft 42, 44. It should be noted that each of the first and second camshafts 42, 44 can have a cam phaser 46 associated therewith, although FIG. 2 only shows one cam phaser 46. An intake valve 58 may be located in the intake port 34 and the first valve lift mechanism 50 may be engaged with the intake valve 58. An exhaust valve 60 may be located in the exhaust port 36 and the second valve lift mechanism 52 may be engaged with the exhaust valve 60. Additional intake and exhaust ports may be provided in each cylinder along with additional intake and exhaust valves disposed therein. The cam phaser 46 can be a mid-park or end-park cam phaser as is generally known in the art, although other cam phaser designs can be used.

With reference to FIG. 2, the cam phaser actuation hydraulic supply system 70 for advancing or retarding the cam phaser 46 for adjusting the rotational position of the camshaft 42 according to the principles of the present disclosure will now be described. The hydraulic supply system 70 includes a lubrication system 71 having a main oil pump 72 which can be a variable displacement pump. The main oil pump 72 can be utilized for providing lubrication oil to the valvetrain assembly 20 as well as other engine components. The main oil pump 72 draws oil from sump 74 and delivers oil through a main passage 76 through a check valve 78 and filter 80. From the filter 80, the oil can be delivered to various components of the valvetrain assembly 20 and returned to the sump 74 as is known in the art.

A secondary positive displacement oil pump 82 can be engaged to be driven by the engine drive system 83 that drives the main oil pump 72 via an electro-hydraulic clutch system 84. The clutch system 84 can be engaged by a two port/two position solenoid valve 86 for selective actuation of the clutch 84 to engage the secondary pump drive 88 for driving the secondary oil pump 82. The solenoid valve 86 receives filtered oil from the main oil pump 72 via passage 90. Passage 90 is also connected to the supply port 92 of the secondary oil pump 82. The outlet 94 of the secondary oil pump 82 is connected to a hydraulic accumulator 100. The hydraulic accumulator 100 is in communication with the cam phaser 46 through a three position valve 102. As is known in the art, the three position valve associated with the cam phaser 46 has three positions that include a first position for advancing the cam phaser 46, a second position for retarding the position of the cam phaser 46, and a third intermediate position that allows for modulation of the cam phaser position. It should be noted that other cam phaser arrangements and valve arrangements can be utilized including normally advanced or normally retarded position cam phasers.

An optional pressure reducing valve 104 can be provided in the passage between the hydraulic accumulator 100 and the cam phaser 46 that allows the cam phaser to operate at a different pressure than the accumulator 100. In addition, a two port/three position proportional valve 106 can optionally be used for selective charging of the cam phaser system and or discharging of the accumulator 100. It is noted that the three position arrangement of the two port/three position proportional valve 106 includes a first closed position 106*a*, a second restricted flow position 106*b*, and a third accumulator discharge position 106*c*. As an alternative to the proportional valve, a one-way check valve can be used with limited function.

The hydraulic system of the present disclosure is configured to provide a low-cost solution to enable aggressive cam phaser movement over a broad range of operating conditions including engine "off" conditions. In the engine "off" condition, the main oil pump 72 is not being driven and is incapable of providing oil to the cam phaser 46. Accordingly, the accumulator 100 stores pressurized oil that can be used during engine "off" conditions to adjust the position of the cam phaser 46.

The internal combustion engine 10 is provided with a controller 110 that monitors vehicle operating conditions via inputs 112. During vehicle and engine deceleration, the controller 110 provides output signals via connection 114 to engage the two port/two position solenoid valve 86 for engaging the electro-hydraulic clutch 84 to drive the secondary oil pump 82 and charge the hydraulic accumulator 100. Therefore, braking energy can be utilized for charging the accumulator 100 by regeneration rather than providing any parasitic losses that reduce fuel efficiency. The hydraulic accumulator 100 is selectively charged during engine deceleration so that when the engine is in an "off" condition, the stored pressurized fluid in the accumulator 100 can be utilized for adjusting the cam phaser 46 prior to the next engine startup. The ability to adjust the cam phaser 46 prior to engine startup allows for improved engine starting with an adjustment to a lower compression ratio at startup. Accordingly, the system of the present disclosure provides for full cam phasing authority both prior to engine start and during engine operation. The system of the present disclosure also minimizes any adverse impact on engine parasitic losses by recharging the accumulator 100 during vehicle decelerations. The system also provides for a hydraulic isolation of the cam phaser 46 for providing stable control of the cam phaser 46. By using a dedicated secondary oil pump 82, the main oil pump 72 can be operated at a lower pressure for providing adequate lubrication to the engine bearings and valve-train components while providing improved fuel economy. The secondary oil pump 82 and accumulator 100 also allows the freedom to operate the cam phaser 46 at higher operating pressures for improved phaser response without adversely affecting the optimized main oil pump 72 operating pressure for the rest of the engine. The system also allows for the use of a mid-park cam phaser to meet stop and start goals thereby mitigating the need for complex "dual park" cam phaser designs. The present disclosure allows for potential of compression release for improved starting over broad temperature ranges.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An internal combustion engine for a vehicle, comprising:

an engine block defining a plurality of cylinders:

a cylinder head mounted to the engine block and defining intake ports and exhaust ports in communication with the cylinders;

a valvetrain system including a plurality of intake valves disposed within the intake ports and a plurality of exhaust valves disposed within the exhaust ports;

a camshaft operable to open at least one of the plurality of intake valves and the plurality of exhaust valves;

a hydraulic cam phaser including at least one of an advance chamber and a retard chamber for receiving hydraulic fluid for advancing or retarding a rotational position of the camshaft;

a hydraulic actuation system including a hydraulic accumulator in selective communication with the at least one of the advance and retard chambers of the hydraulic cam phaser; and a first system oil pump for providing lubrication oil to engine bearings and the valvetrain system, said hydraulic actuation system including a second oil pump for supplying oil to said hydraulic accumulator, wherein the second oil pump is selectively controlled with a clutch device connecting said second oil pump to the engine drive system, said internal combustion engine includes a controller which controls actuation of the clutch device to actuate the clutch device during deceleration of the vehicle.

2. The internal combustion engine for vehicle according to claim 1, wherein the first system oil pump and the second oil pump are driven by an engine drive system.

3. The internal combustion engine for vehicle according to claim 1, further comprising a solenoid valve controlled by said controller and in communication with the first system oil pump and the clutch device for supplying oil to the clutch device for engaging the clutch device.

4. The internal combustion engine for vehicle according to claim 1, further comprising a pressure reducing valve disposed between the accumulator and the hydraulic cam phaser.

5. The internal combustion engine for vehicle according to claim 1, further comprising a check valve disposed between the first system oil pump and the hydraulic cam phaser.

6. The internal combustion engine for vehicle according to claim 1, further comprising a proportional solenoid valve for selective actuation of the hydraulic cam phaser.

7. A camshaft phaser actuation supply system for an internal combustion engine having a hydraulic camshaft phaser, comprising:

a hydraulic actuation system including a first system oil pump for providing lubrication oil to components of the engine;

a hydraulic accumulator in selective communication with the hydraulic cam phaser, said hydraulic actuation system including a second oil pump for supplying oil to said hydraulic accumulator, wherein the second oil pump is selectively controlled with a clutch device connecting said second oil pump to the engine drive system, said internal combustion engine includes a controller which controls actuation of the clutch device to actuate the clutch device during deceleration of the engine.

8. The camshaft phaser actuation supply system according to claim 7, wherein the first system oil pump and the second oil pump are driven by an engine drive system.

9. The camshaft phaser actuation supply system according to claim 7, further comprising a solenoid valve controlled by said controller and in communication with the first system oil pump and the clutch device for supplying oil to the clutch device for engaging the clutch device.

10. The camshaft phaser actuation supply system according to claim 7, further comprising a pressure reducing valve disposed between the accumulator and the hydraulic cam phaser.

11. The camshaft phaser actuation supply system according to claim 7, further comprising a check valve disposed between the first system oil pump and the hydraulic cam phaser.

12. The camshaft phaser actuation supply system according to claim 7, further comprising a proportional solenoid valve for selective actuation of the hydraulic cam phaser.

* * * * *